US007422798B2

(12) United States Patent
Giorni et al.

(10) Patent No.: US 7,422,798 B2
(45) Date of Patent: Sep. 9, 2008

(54) VAPOUR TURBINE

(75) Inventors: Eugenio Giorni, Florence (IT); Riccardo Paoletti, Campi Bisenzio (IT); Marco De Iaco, Florence (IT); Paolo Bendinelli, Quattro Strade Di Lavaiano-Lari (IT)

(73) Assignee: General Electric Company, Schenectady, NY (US)

( * ) Notice: Subject to any disclaimer, the term of this patent is extended or adjusted under 35 U.S.C. 154(b) by 136 days.

(21) Appl. No.: 11/311,383

(22) Filed: Dec. 20, 2005

(65) Prior Publication Data

US 2006/0140773 A1 Jun. 29, 2006

(30) Foreign Application Priority Data

Dec. 23, 2004 (IT) ..... MI04A2488

(51) Int. Cl.

| | |
|---|---|
| ***B32B 15/01*** | (2006.01) |
| ***B32B 15/04*** | (2006.01) |
| ***B32B 15/20*** | (2006.01) |
| ***F03G 4/00*** | (2006.01) |
| ***F03G 4/02*** | (2006.01) |
| ***F03G 4/04*** | (2006.01) |
| ***F03G 4/06*** | (2006.01) |

(52) U.S. Cl. ..... 428/680; 428/627; 428/334; 416/241 R; 416/229 A; 60/641.2; 60/641.3; 60/641.4; 60/721

(58) Field of Classification Search ..... 428/627, 428/666, 680, 215, 216, 334, 335, 336, 457; 416/241 R, 229 A, 223 A; 60/641.1, 641.2, 60/641.3, 641.4, 641.5, 721; 29/889.7, 889.71, 29/889.2

See application file for complete search history.

(56) References Cited

U.S. PATENT DOCUMENTS 4,496,635 A * 1/1985 Wang et al. ..... 428/680

FOREIGN PATENT DOCUMENTS

JP 07-278780 * 10/1995

* cited by examiner

*Primary Examiner*—Michael La Villa
(74) *Attorney, Agent, or Firm*—Nixon & Vanderhye, PC

(57) ABSTRACT

Vapour turbine operating with geothermal vapours containing corrosive agents or aggressive substances such as chlorides and/or sulfides in particular. The turbine comprises a series of stator blades and a series of rotor blades, each stator blade of the series of stator blades comprises a surfacing consisting of a nickel alloy containing a quantity of nickel ranging from 54% to 58% by weight to avoid the washing of the geothermal vapours, at the same time maintaining a high useful life of the series of stator blades and vapour turbine.

5 Claims, No Drawings

VAPOUR TURBINE

This application is a new U.S. utility application claiming priority to IT MI2004A002488 filed 23 Dec. 2004, the entire content of which is hereby incorporated by reference.

The present invention relates to a vapour turbine which can be used for obtaining energy from geothermal vapours.

Vapour turbines which operate with geothermal vapours come into contact with aggressive and/or corrosive substances for the components of the turbine itself.

Even small quantities of aggressive substances such as chlorides and sulfides, cause the corrosion of the vapour turbine components, such as rotor blades, stator blades and sealing laminas.

The materials currently used for vapour turbine components are martensitic stainless steels which are strongly subject to corrosion phenomena on the part of aggressive and/or corrosive agents.

The corrosion is particularly high in the transition area between overheated vapour and damp vapour (Dew Point).

In this area, the solid particles contained in the geothermal vapour form large deposits on the surface of the blades.

During the functioning of the turbine, the deposits accelerate the corrosion process due to the increase in localized concentration of corrosive agents such as chlorides and sulfides.

Corrosion of the turbine components jeopardizes the correct functionality of the turbine itself as well as the preventive maintenance plan programmed for it.

In order to reduce maintenance interventions and consequently also substitution of the components themselves, the geothermal vapours containing aggressive substances in a higher quantity than a predetermined percentage, are "washed" with water.

This reduces the concentration of aggressive substances present in the geothermal vapours.

A first disadvantage is that the washing operations of geothermal vapours causes an increase in the running and maintenance costs of the plant, also increasing its complexity.

Another disadvantage is that washing the vapour reduces the enthalpy available at the turbine inlet and consequently the useful work of the turbine itself is reduced.

An objective of the present invention is to provide a vapour turbine operating with overheated geothermal vapours normally containing corrosive agents which avoids the washing of said geothermal vapours.

A further objective is to provide a vapour turbine operating with geothermal vapours, normally containing corrosive agents which has a high conversion efficiency of the energy available at the inlet.

Another objective to provide a vapour turbine operating with geothermal vapours, normally containing corrosive agents, which operates with overheated geothermal vapours and which has a high useful life.

Yet another objective to provide a vapour turbine operating with geothermal vapours, normally containing corrosive agents having reduced maintenance costs.

These objectives according to the present invention are achieved by providing a vapour turbine as illustrated in claim 1.

Further characteristics of the invention are indicated in the subsequent claims.

The characteristics and advantages of a vapour turbine operating with geothermal vapours will appear more evident from the following illustrative and non-limiting description of the present invention.

According to the present invention, a vapour turbine is provided, operating with geothermal vapours containing aggressive or corrosive agents such as chlorides and/or sulfides in particular.

The vapour turbine comprises a series of stator blades and a series of rotor blades, each stator blade of said series of stator blades comprises a surfacing consisting of a nickel alloy containing a quantity of nickel ranging from 54% to 58% by weight to avoid the washing of said geothermal vapours, at the same time maintaining a high useful life of said series of stator blades and said vapour turbine.

It is advantageously possible to convert, by means of said turbine, a greater quantity of energy as the non-washed geothermal vapours have a higher enthalpy with respect to washed geothermal vapours.

Said turbine is advantageously particularly efficient for geothermal vapours containing a quantity of chlorides higher than 2 ppm avoiding the washing thereof.

Said nickel alloy is preferably a nickel-chromium-molybdenum alloy.

Said nickel alloy preferably comprises a quantity of chromium ranging from 21% to 23% by weight, a quantity of molybdenum ranging from 12% to 14% by weight.

Said nickel alloy is preferably a super-alloy of nickel known commercially as HASTELLOY C22.

Said surfacing made of nickel alloy preferably has a thickness ranging from 20 μm to 250 μm.

Said turbine preferably also comprises a series of sealing laminas made of said nickel alloy and in particular made of HASTELLOY C22.

The purpose of this is to avoid the washing of said geothermal vapours, maintaining a high useful life of said series of stator blades and said series of sealing laminas of said vapour turbine.

Each rotor blade of said series of rotor blades of said vapour turbine preferably comprises a surfacing made of chromium carbide to avoid the washing of said geothermal vapours, at the same time maintaining a high useful life of each rotor blade and of the vapour turbine itself.

Said surfacing consisting of chromium carbide preferably has a thickness ranging from 100 μm to 700 μm.

According to a further aspect of the present invention, the use of a surfacing consisting of a nickel alloy, in particular HASTELLOY C22, for a stator blade of a vapour turbine operating with geothermal vapours containing corrosive agents, such as chlorides and/or sulfides in particular, is evident to avoid the washing of said geothermal vapours, maintaining a high useful life of said stator blade.

According to another aspect of the present invention, the use of a surfacing consisting of chromium carbide for a rotor blade of a vapour turbine operating with geothermal vapours containing corrosive agents, such as chlorides and/or sulfides in particular, is evident, to avoid the washing of said geothermal vapours, maintaining a high useful life of said rotor blade.

Advantageously a vapour turbine of the present invention is capable of operating with overheated geothermal vapour and is also capable of avoiding washing operations of the geothermal vapour when this contains corrosive substances such as chlorides and/or sulfides in a quantity higher than 2 ppm.

It can thus be seen that a vapour turbine according to the present invention achieves the objectives specified above.

The vapour turbine of the present invention thus conceived can undergo numerous modifications and variants, all included in the same inventive concept.

Furthermore, in practice, their dimensions and components can vary according to technical demands.

The invention claimed is:

1. A vapour turbine operating with geothermal vapours containing corrosive agents or substances, said turbine comprising a series of stator blades and a series of rotor blades, wherein each stator blade of the series of stator blades comprises a surfacing comprised of a nickel-chromium-molybdenum alloy containing a quantity of nickel ranging from 54% to 58% by weight of said nickel alloy; a quantity of chromium ranging from 21% to 23% by weight of said nickel alloy; a quantity of molybdenum ranging from 12% to 14% by weight of said alloy.

2. The turbine according to claim 1, wherein said surfacing has a thickness ranging from 20 μm to 250 μm.

3. The turbine according to claim 1, wherein said surfacing comprises a series of sealing laminas made of said alloy.

4. The turbine according to claim 1, wherein each rotor blade of said series of rotor blades comprises a chromium carbide surfacing.

5. The turbine according to claim 4, wherein said chromium carbide surfacing has a thickness ranging from 100 μm to 700 μm.

* * * * *

UNITED STATES PATENT AND TRADEMARK OFFICE

CERTIFICATE OF CORRECTION

PATENT NO. : 7,422,798 B2
APPLICATION NO. : 11/311383
DATED : September 9, 2008
INVENTOR(S) : Giorni et al.

It is certified that error appears in the above-identified patent and that said Letters Patent is hereby corrected as shown below:

At column 3 line 8, after the word “said” delete the word --nickel--;

At column 3 line 9, after the word “said” delete the word --nickel--;

At column 3 line 10, after the word “alloy;” insert the word --and--.

Signed and Sealed this

Twenty-fourth Day of February, 2009

JOHN DOLL
*Acting Director of the United States Patent and Trademark Office*